US005862807A

United States Patent [19]

Pohl et al.

[11] Patent Number: 5,862,807

[45] Date of Patent: Jan. 26, 1999

[54] APPARATUS FOR HEATING THE ADHESIVE-CONTAINING SEAMS OF WRAPPERS OF RODS OF THE TOBACCO PROCESSING INDUSTRY

[75] Inventors: Klaus-Jürgen Pohl, Reinbek; Alfred Drenguis, Hamburg, both of Germany

[73] Assignee: Hauni Maschinenbau AG, Hamburg, Germany

[21] Appl. No.: 760,697

[22] Filed: Dec. 5, 1996

[30] Foreign Application Priority Data

Dec. 22, 1995 [DE] Germany ..... 195 48 148.8

[51] Int. Cl.[6] ..... A24C 5/14

[52] U.S. Cl. ..... 131/68; 131/69; 131/84.1; 219/260; 219/270

[58] Field of Search ..... 131/68, 69, 84.1, 131/67; 219/270, 260; 493/41, 43

[56] References Cited

U.S. PATENT DOCUMENTS

| | | | |
|---|---|---|---|
| 3,575,766 | 4/1971 | McArthur et al. | 131/68 |
| 3,974,007 | 8/1976 | Greve | 131/68 |
| 3,996,447 | 12/1976 | Bouffard et al. | 219/541 |
| 4,480,644 | 11/1984 | Luke | 131/68 |
| 4,721,119 | 1/1988 | Ludszeweit et al. | 131/68 |
| 5,191,381 | 3/1993 | Yuan | 355/285 |

FOREIGN PATENT DOCUMENTS

| | | | |
|---|---|---|---|
| 4437 631 | 4/1996 | Germany | 131/68 |
| WO 94 20284 | 9/1994 | WIPO | 131/68 |

*Primary Examiner*—Vincent Millin
*Assistant Examiner*—Charles W. Anderson
*Attorney, Agent, or Firm*—Darby & Darby

[57] ABSTRACT

A sealer for the adhesive-containing seam of a tubular wrapper surrounding a running filler of tobacco or filter material for tobacco smoke has an at least partially ceramic heating device which contacts the moving seam and contains an electric conductor of ceramic material. The temperature of the heating device can be regulated to decrease, either stepwise or gradually, in the direction of movement of the seam. The heating device can consist of or contain silicon nitride and can be doped with titanium nitride to enhance its heat conductivity.

14 Claims, 2 Drawing Sheets

APPARATUS FOR HEATING THE ADHESIVE-CONTAINING SEAMS OF WRAPPERS OF RODS OF THE TOBACCO PROCESSING INDUSTRY

BACKGROUND OF THE INVENTION

The invention relates to improvements in apparatus, known as sealers or band sealers, which can be utilized in machines for the making of rod-shaped products of the tobacco processing industry to heat and thus stabilize or strengthen the adhesive-containing seams of tubular wrappers for rod-like fillers of tobacco, filter material for tobacco smoke or other material of the tobacco processing industry. For example, the improved apparatus can be utilized to stabilize the longitudinally extending seam of a tubular wrapper which consists of cigarette paper and surrounds a rod-like filler of natural, reconstituted and/or artificial tobacco while the filler advances from a wrapping mechanism to a so-called cutoff of a cigarette rod making machine.

The purpose of the sealer is to condition the moving adhesive-containing seam of the tubular wrapper for the purpose of heating the adhesive in the seam. This causes a water-base adhesive to set or liquefies an adhesive of the type known as hot melt. As a rule, an elongated heated strip-shaped heating device is maintained in actual contact with the exposed outer side of the outer layer of the moving seam.

The strip-shaped heating devices of conventional sealers are made of a metallic material and are connected with heating cartridges which, as a rule, are installed at a considerable distance from the locus of contact between the heating device and the seam. This renders it necessary to employ cartridges whose thermal output is relatively high which, in turn, brings about serious problems during certain stages of operation of such conventional sealers. Thus, the seam portion which contacts the sealer when a cigarette maker is brought to a halt is likely to be overheated and a seam portion which is caused to move along the sealer immediately after the cigarette maker is started or restarted is likely to be heated to a temperature well below the optimum temperature for the particular adhesive. An overheating of te seam is likely to entail charring or other undesirable consequences involving an undesirable change of appearance and/or the strength of the overheated portion of the seam. On the other hand, underheating of the seam can adversely affect the strength of the respective portion of the seam, i.e., the seam is likely to open up during advancement through the cutoff which is located downstream of the sealer as considered in the direction of advancement of a wrapped rod-like filler in a cigarette maker or another rod making machine of the tobacco processing industry.

Another drawback of conventional sealers is that losses due to undesirable heat radiation are very high. Furthermore, the temperature of a conventional sealer cannot be regulated with a desired degree of accuracy and/or within a short or very short interval of time. The reason is that the thermal inertia of conventional sealers is too pronounced. Still another drawback of conventional sealers which include metallic seam-contacting portions is that such portions are likely to become distorted in response to unavoidable fluctuations of their temperature; this can result in the development of unsatisfactory contact between the metallic portion and the moving seam.

U.S. Pat. No. 3,575,766 granted Apr. 20, 1971 to McArthur et al. discloses a band sealer for a cigarette or filter maker wherein the moving seam of a tubular wrapper of cigarette paper or the like is contacted by a thin strip consisting of a metallic material. The strip conducts electric current and forms part of an electric resistance heater, i.e., the heat to be transmitted to the seam is generated directly in the metal strip.

OBJECTS OF THE INVENTION

An object of the invention is to provide an apparatus which constitutes an improvement over the band sealer disclosed in the U.S. Pat. No. 3,575,766 to McArthur et al.

Another object of the invention is to provide an apparatus which is less likely to overheat or underheat a seam than heretofore known apparatus.

A further object of the invention is to provide an apparatus which is constructed and assembled and which can be operated in such a way that its temperature can be regulated with a high degree of accuracy and reproducibility as well as within the required short or extremely short intervals of time.

An additional object of the invention is to provide an apparatus which can be installed in existing rod making machines of the tobacco processing industry as a superior substitute for conventional band sealers.

Still another object of the invention is to provide an apparatus whose useful life is much longer than that of conventional band sealers.

A further object of the invention is to provide an apparatus which is constructed and assembled in such a way that its seam contacting portion or portions are less likely to be distorted in response to fluctuations of temperature than the corresponding portions of heretofore known band sealers.

Another object of the invention is to provide an apparatus whose energy requirements are less pronounced than those of heretofore known sealers.

An additional object of the invention is to provide a novel and improved method of conditioning the adhesive-containing seams of tubular wrappers of cigarette paper or the like.

SUMMARY OF THE INVENTION

The invention is embodied in an apparatus for conditioning an elongated adhesive-containing seam of a tubular wrapper for a rod-like filler containing a material of the tobacco processing industry (such as natural, reconstituted or artificial tobacco or filter material for tobacco smoke) and being advanced in a predetermined direction along a predetermined path, e.g., toward and through a so-called cutoff which divides the wrapped filler into a file of elongated rod-like sections of unit length or multiple unit length. The improved apparatus can form part of or can be installed in a cigarette making machine and comprises a heating device which is positionable at the seam in the predetermined path and has a seam-contacting surface. In accordance with a feature of the invention, at least a portion of the heating device consists of a ceramic material and such ceramic portion includes at least a portion of the seam-contacting surface. The tubular wrapper can consist of cigarette paper which surrounds a rod-like filler of smokable material or of another wrapping material, e.g., a material which is used to surround a rod-like filler of filter material for tobacco smoke.

The heating device of the improved apparatus preferably further comprises an electric conductor which is at least partially confined in the portion of ceramic material. Such conductor can contain or can consist of a ceramic material, particularly a ceramic material which is a good conductor of electric current. The aforesaid portion of ceramic material includes a part which is disposed between the conductor and the seam-contacting surface and preferably consists of a heat conductive ceramic material.

The heating device can comprise a plurality of sections, and such apparatus can further comprise means for heating the sections at least substantially independently of each other. Such heating means can include or constitute means for regulating the temperature of the portion of ceramic material so that the temperature varies in the predetermined direction. The regulating means can include means for reducing the temperature of the portion of ceramic material in the predetermined direction in a stepwise fashion or at least substantially gradually. Otherwise stated, the seam-contacting surface can have at least one upstream portion which is maintained at a relatively high temperature and at least one downstream portion which is maintained at an at least slightly lower temperature.

The portion of ceramic material can contain or can consist of silicon nitride, and such portion can contain a suitable dope which enhances the heat conductivity of the heating device. A presently preferred dope is titanium nitride.

The novel features which are considered as characteristic of the invention are set forth in particular in the appended claims. The improved seam conditioning apparatus itself, however, both as to its construction and its mode of operation, together with additional novel features and advantages thereof, will be best understood upon perusal of the following detailed description of certain presently preferred specific embodiments with reference to the accompanying drawings.

DESCRIPTION OF PREFERRED EMBODIMENTS

Figure 1:
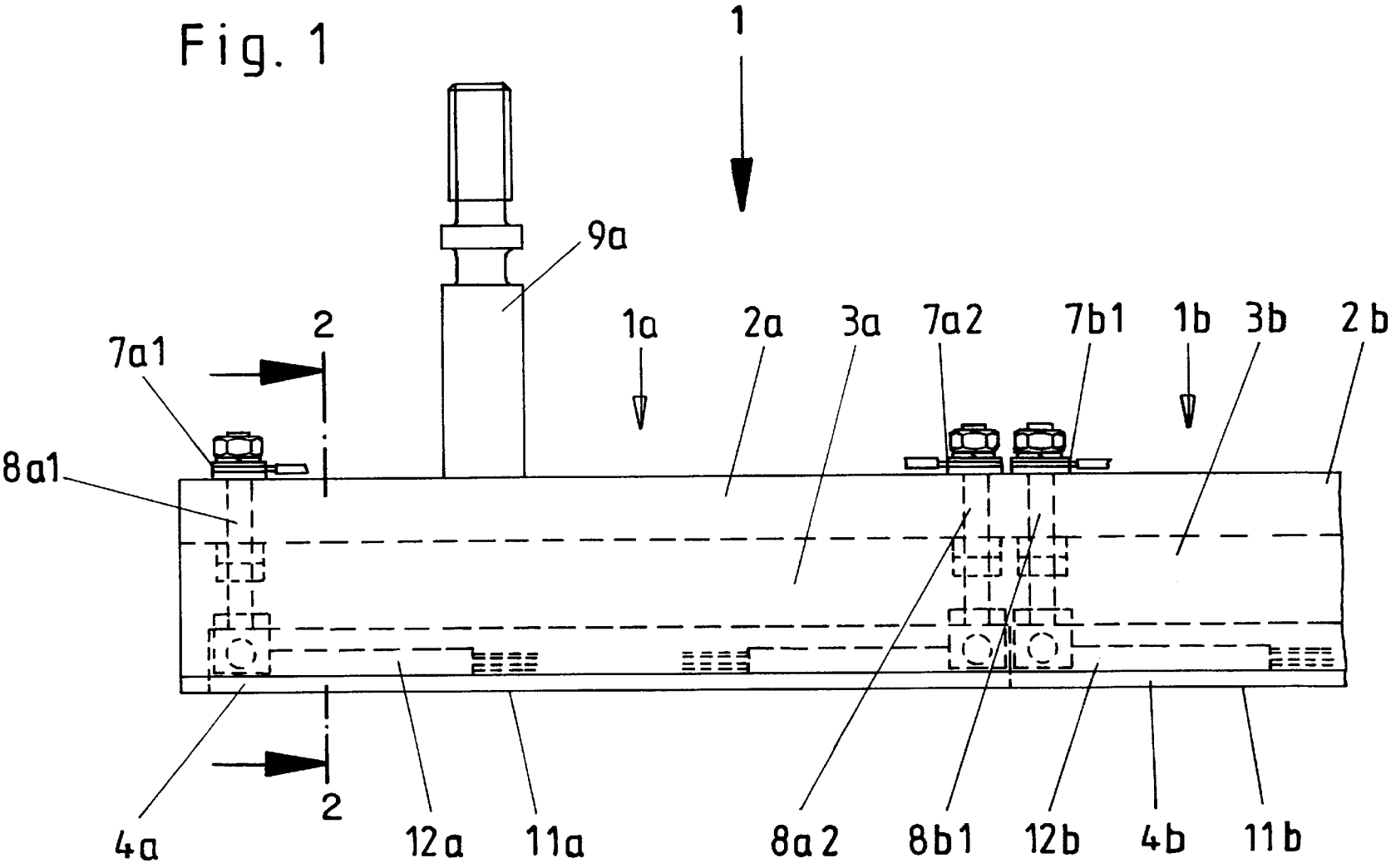
FIG. 1 is an enlarged fragmentary elevational view of a seam conditioning apparatus which embodies one form of the invention.
Figure 2:
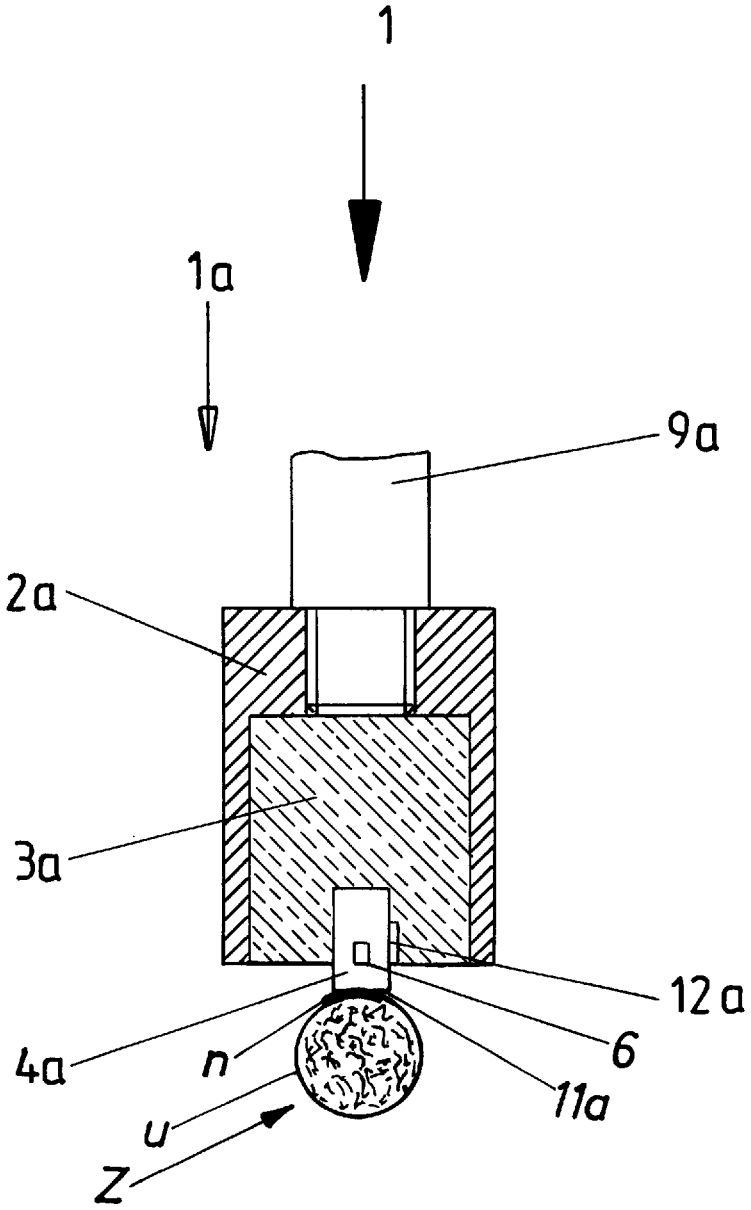
FIG. 2 is an enlarged transverse sectional view substantially as seen in the direction of arrows from the line 2—2 in FIG. 1 and further shows a wrapped filler having a freshly formed adhesive-containing seam in contact with the surface of the improved heating device.

FIGS. 1 and 2 show a portion of an apparatus 1 (hereinafter called sealer for short) which can be utilized in a machine for the making of wrapped rod-like fillers Z containing a material of the tobacco processing industry, such as natural, reconstituted or synthetic tobacco or filter material for tobacco smoke. For example, the sealer 1 can be utilized in a cigarette rod making machine of the type described and shown (in part) in commonly owned U.S. Pat. No. 4,721,119 granted Jan. 26, 1988 to Ludszeweit et al., or in a filter rod making machine of the type disclosed in U.S. Pat. No. 3,974,007 granted Aug. 10, 1976 to Greve. The disclosures of these patents, as well as that of the aforementioned U.S. Pat. No. 3,575,766 to McArthur et al., are incorporated herein by reference.

The sealer 1 comprises a plurality of elongated sections (two such sections are shown in FIG. 1, as at 1*a* and 1*b*) each of which preferably includes a discrete housing (FIG. 1 shows the housings 2*a* and 2*b*), and the housings define internal spaces or chambers (shown at 3*a*, 3*b*) containing bodies of heat-resistant material (indicated in FIG. 2 by criss-cross hatching); such bodies can be made of heat-resistant foamed plastic material and can serve as gaskets, packings, seals and/or insulators.

The sealer 1 further comprises an elongated heating device including aligned sections 4*a* and 4*b*, one for each of the illustrated sealer sections 1*a*, 1*b*. In accordance with a feature of the invention, at least a portion of each section of the heating device consists of a heat-conducting ceramic material. For example, the sections 4*a*, 4*b* of the heating device can be made of silicon nitride ($Si_3N_4$) which is or which can be doped with one or more heat conductivity enhancing substances, e.g., with tantalum nitride (TaN).

Portions of the sections 4*a*, 4*b* extend from the bodies of foamed material in the respective chambers 3*a*, 3*b* and have plane or concave surfaces 11*a*, 11*b* in actual contact with the exposed outer side of the outer layer of the seam n forming part of the tubular wrapper u for the filler Z of the continuous rod advancing in the rod making machine along a predetermined path and in a predetermined direction, namely toward or away from the observer of FIG. 2. A concealed side of the seam n faces the filler z.

The sealer 1 further comprises electric conductors 6 shown as being fully embedded in the respective sections 4*a*, 4*b* of the heating device and forming part of the means for regulating the temperature of the sections 4*a*, 4*b*, for example and preferably in such a way that the temperature of each of the sections 4*a*, 4*b* can be selected and/or varied independently of the other of these sections. The temperature regulating means further comprises suitable electric terminals which are connected with the respective conductors 6. FIG. 1 shows two terminals 7*a*1, 7*a*2 for the conductor 6 in the section 4*a*; these terminals are confined in sockets 8*a*1, 8*a*2 which are provided in the section 1*a*. A further terminal 7*b*1 is connected to one end portion of the conductor 6 in the section 4*b*; this terminal is anchored in a socket 8*b*1 of the section 1*b*. It is clear that the means for regulating the temperature of the conductor 6 in the section 4*b* (and hence the temperature of the section 4*b*) includes a second terminal located to the right of that portion of the section 1*b* which is shown in FIG. 1. The exact manner in which the terminals including those shown at 7*a*1, 7*a*2 and 7*b*1 are connected to a suitable source of electrical energy so that the conductors 6 in the ceramic sections 4*a*, 4*b* can be heated at least substantially independently of each other forms no part of the present invention.

The reference character 9*a* denotes a bolt or another suitable fastener which can be used to secure the sealer 1 in a rod making machine in such a way that the surfaces 11*a*, 11*b* of the sections 4*a*, 4*b* contact the adjacent portions of the moving seam n. At least one additional bolt or another suitable fastener can be utilized to connect another portion of the sealer 1 (e.g., the housing 2*b*) to a rod making machine downstream of the wrapping mechanism and upstream of the cutoff.

Though the illustrated sealer 1 comprises several sections (including the two sections shown at 1*a* and 1*b*), it is equally within the purview of the invention to reduce the number of such sections (and hence of the ceramic sections) to one or to increase such number to three or more. Furthermore, a single section (such as 1*a*) of the improved sealer can comprise two or more discrete elongated ceramic sections. Still further, it is also possible to provide the improved sealer with a single ceramic section (such as 4*a*) and with one or more seam-contacting sections of a metallic material or any other suitable material. It is presently preferred to employ a sealer which is designed in such a way that the moving seam n is contacted only by one or more elongated sections of a suitable ceramic material, preferably a ceramic material which is a good conductor of heat.

The aforementioned temperature regulating means preferably further comprises temperature monitoring means serving to transmit signals denoting the actual temperatures at the surfaces 11*a* and 11*b*. FIG. 1 shows two temperature sensors 12*a*, 12*b* (the sensor 12*a* is also shown in FIG. 2) which are associated with the respective ceramic sections 4*a*, 4*b* and the signals from which influence the energy sources for the conductors 6. The regulating means can be set up in such a way that an operator can select a desired heating action for each of the sections 4*a*, 4*b* and the rate at which the energy is supplied to the conductors 6 is varied in dependency upon signals from the sensors 12*a*, 12*b*. The arrangement can be such that, if the filler Z is caused to advance in a direction from the right to the left, as viewed in FIG. 1, the heating action of the section 4*b* is more pronounced than that of the section 4*a*, i.e., the heating action decreases (either stepwise or gradually) in the direction of movement of the seam n relative to the sealer 1. The reason is that, as a rule, a more pronounced heating action is required at the upstream end of the sealer than at the downstream end, i.e., a more pronounced drying or heating action (depending upon the nature of the adhesive in the seam n) is normally required at the locus of initial contact between successive increments of the seam and the at least partially ceramic heating device of the sealer.

As already mentioned above, the heating action upon the moving seam n can be varied stepwise or gradually. A simple stepwise variation (particularly a reduction) of the heating action can be achieved with the illustrated apparatus having several discrete ceramic sections (4*a*, 4*b*) each including a discrete conductor 6 connected to the energy source at least substantially independently of the other conductor or conductors. This renders it possible to reduce the heating action of the sealer 1 in stepwise fashion as seen in the direction of advancement of the filler Z and the seam n. If the heating action is to be varied gradually, a continuous seam-contacting heat-transmitting surface (such as a surface including the illustrated surfaces 11*a* and 11*b*) can be imparted a desired heating profile by employing a ceramic section (such as a single section replacing the illustrated sections 4*a* and 4*b*) having a heat conductivity which varies gradually from its upstream end toward its downstream end, again as seen in the direction of advancement of the seam n. This can be readily achieved by varying the quantities and/or the nature of doping material in different parts of the ceramic section. Of course, it is also possible to design one of the sections 4*a*, 4*b* in such a way that its heat conductivity varies in a direction from one of its ends toward the other end but the conductivity of the other section remains unchanged. As a rule, the exact mode of varying the heating action in the direction of advancement of the seam n will depend upon the nature of the adhesive in the seam, on the intensity of heating action, on the speed of the seam and (if necessary) upon one or more additional variable parameters.

An important advantage of the improved sealer is that one can readily select a ceramic material having an optimum thermal conductivity, preferably a rather high conductivity. In other words, one can select a ceramic material having a low or extremely low thermal inertia which renders it possible to ensure that the temperature of the entire ceramic heating device or of certain portions of such heating device can be changed with little loss in time. Thus, the temperature of the seam-contacting surface or surfaces (such as 11*a* and 11*b*) can be readily maintained at or at least close to an optimum temperature; this, in turn, reduces the likelihood of turning out unsatisfactory cigarettes, cigarillos, cigars, filter rod sections or other rod-shaped articles of the tobacco processing industry or, at the very least, renders it possible to greatly reduce the numbers of defective rod-shaped articles. It has been found that the improved sealer is less likely to overheat the adjacent portion of the seam when the rod making machine is brought to a halt and/or to insufficiently heat the adjacent portion of the seam when the machine is started or restarted than a conventional sealer.

Another important advantage of the improved sealer is that its energy requirements are less pronounced than those of a conventional sealer employing metallic seam contacting means. This is due to the fact that different sections of the heating device can be heated to a different extent which is desirable on the additional ground that the entire sealer is less likely to be overheated than presently known sealers. The rate at which a properly selected ceramic material radiates heat is particularly advantageous when such ceramic material is employed in a sealer to constitute or to form part of the heating device (which, in the illustrated embodiment, includes the portions or sections 4*a* and 4*b*). Such desirable property of certain ceramic materials (e.g., silicon nitride or properly doped silicon nitride) renders it possible to reduce the area(s) of the seam-contacting surface (s) (such as 11*a* and 11*b*) and to thus reduce the overall length of the sealer. This is highly desirable in modern high-speed cigarette making and other rod-making machines of the tobacco processing industry.

Still another important advantage of a sealer which employs a properly selected ceramic heating device is that the resistance of such heating device to wear is much more satisfactory than that of a metallic heating device. This is particularly important in modern high-speed cigarette makers and analogous machines which turn out huge quantities of rod-shaped articles per unit of time, i.e., the heating device is in contact with a rapidly advancing adhesive-containing seam of cigarette paper or other suitable wrapping material for fillers of tobacco or other material of the tobacco processing industry.

A further advantage of the improved sealer is that the resistance of a properly selected ceramic material to deformation is more satisfactory than that of heretofore utilized metallic heating devices. A metallic heating device is likely to undergo pronounced deformation or distortion in response to repeated pronounced fluctuations of the temperature. This can result in absence of satisfactory contact between the surface of a metallic heating device and the moving seam.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of conditioning adhesive-containing seams of tubular wrappers for rod-like fillers of tobacco or the like, and such adaptations should and are intended to be comprehended within the meaning and range of equivalence of the appended claims.

What is claimed is:

1. Apparatus for conditioning an elongated adhesive-containing seam of a tubular wrapper for a filler containing a material of the tobacco processing industry and being advanced in a predetermined direction along a predetermined path, said seam having an exposed side and a concealed side confronting the filler, comprising a heating device positionable at the exposed side of the seam in said path and having a surface arranged to contact only the exposed side of the seam, at least a portion of said device consisting of a ceramic material and including at least a portion of said surface.

2. The apparatus of claim 1, wherein said surface is arranged to contact the seam of a tubular wrapper consisting of cigarette paper and surrounding a filler of smokable material.

3. The apparatus of claim 1, wherein said heating device forms part of a cigarette making machine.

4. The apparatus of claim 1, wherein said heating device further comprises an electric conductor which is at least partially confined in said portion of ceramic material.

5. The apparatus of claim 4, wherein said conductor contains a ceramic material which conducts electric current.

6. The apparatus of claim 4, wherein said conductor consists of a ceramic material.

7. The apparatus of claim 4, wherein said portion of ceramic material includes a part disposed between said conductor and said surface and consisting of a heat conductive ceramic material.

8. The apparatus of claim 1, wherein said heating device comprises a plurality of sections, and further comprising means for heating said sections at least substantially independently of each other.

9. The apparatus of claim 1, further comprising means for regulating the temperature of said portion of ceramic material so that the temperature varies in said predetermined direction.

10. The apparatus of claim 9, wherein said regulating means includes means for reducing the temperature of said portion of ceramic material in said predetermined direction in a stepwise fashion.

11. The apparatus of claim 9, wherein said regulating means includes means for gradually reducing the temperature of said portion of ceramic material in said predetermined direction.

12. The apparatus of claim 1, wherein said portion of ceramic material contains a heat conductivity enhancing dope.

13. The apparatus of claim 13, wherein said dope includes titanium nitride.

14. The apparatus of claim 1, wherein said portion of ceramic material contains silicon nitride.

* * * * *